US006901920B2

(12) United States Patent
Dohta

(10) Patent No.: US 6,901,920 B2
(45) Date of Patent: Jun. 7, 2005

(54) ENGINE CONTROL APPARATUS HAVING CYLINDER-BY-CYLINDER FEEDBACK CONTROL

(75) Inventor: Hisayo Dohta, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/730,927

(22) Filed: Dec. 10, 2003

(65) Prior Publication Data

US 2004/0112352 A1 Jun. 17, 2004

(30) Foreign Application Priority Data

Dec. 12, 2002 (JP) ..... 2002-360385

(51) Int. Cl.[7] ..... F02D 41/14
(52) U.S. Cl. ..... 123/673; 123/674; 701/109
(58) Field of Search ..... 123/435, 673, 123/674; 701/109

(56) References Cited

U.S. PATENT DOCUMENTS 5,448,978 A * 9/1995 Hasegawa et al. ..... 123/673
6,041,279 A * 3/2000 Maki et al. ..... 123/673
6,382,198 B1 * 5/2002 Smith et al. ..... 123/674
6,397,830 B1 6/2002 Dohta
6,789,534 B2 * 9/2004 Yasui et al. ..... 123/673
6,840,214 B2 * 1/2005 Yasui ..... 123/673

* cited by examiner

*Primary Examiner*—Erick Solis
(74) *Attorney, Agent, or Firm*—Nixon & Vanderhye P.C.

(57) ABSTRACT

In an air-fuel ratio feedback control for an engine, a cylinder-by-cylinder variation value is calculated for each cylinder based on changes of intake pipe pressure detected by an intake pipe pressure sensor, or the like, and a fuel injection amount or the like is corrected for each cylinder based on the variation value. When the variation is large during an engine operation, or until the variation correction is completed, it is determined that the output of an exhaust gas sensor will be disturbed by the variation and an air-fuel ratio feedback correction amount will be disturbed. Therefore, a control gain of the air-fuel ratio feedback control is changed to a value smaller than a normal value, or the feedback control is inhibited.

10 Claims, 10 Drawing Sheets

ENGINE CONTROL APPARATUS HAVING CYLINDER-BY-CYLINDER FEEDBACK CONTROL

CROSS REFERENCE TO RELATED APPLICATION

This application is based on and incorporates herein by reference Japanese Patent Application No. 2002-360385 filed on Dec. 12, 2002.

FIELD OF THE INVENTION

The present invention relates to an internal combustion engine control apparatus for performing a specified feedback control on the basis of output of a sensor for detecting information concerning an operation state of an internal combustion engine having multiple cylinders.

BACKGROUND OF THE INVENTION

In recent years, in an internal combustion engine mounted in a vehicle, a catalyst such as a three-way catalyst for purifying an exhaust gas and an air-fuel ratio sensor for detecting an air-fuel ratio of the exhaust gas representing air-fuel mixture are installed in an exhaust pipe. An air-fuel ratio feedback control to control a fuel injection amount of a fuel injection valve is performed so that the air-fuel ratio of the exhaust gas detected by the air-fuel ratio sensor is controlled to become a target air-fuel ratio (purification window of catalyst), and an exhaust gas purification efficiency of the catalyst is raised.

In such an air-fuel ratio feedback control, as disclosed in U.S. Pat. No. 6,397,830 B1 (JP-A-2001-90584), an air-fuel ratio control model simulating a control object from a fuel injection valve to an air-fuel ratio sensor is constructed. A response time constant of the air-fuel ratio control model is changed in accordance with an engine operation state, and a control gain is changed in accordance with this response time constant so that the characteristic of the air-fuel ratio control model is changed in accordance with the engine operation state. While the stability of the air-fuel ratio feedback control is secured in all the operation region, the response of the air-fuel ratio feedback control over the change of the engine operation state can be improved.

However, in an internal combustion engine including multiple cylinders, variation occurs in the operation states of the respective cylinders due to individual differences of the respective cylinders (parts tolerances, assembly tolerances, etc.), secular change, and the like. When the variations in the operation states among the cylinders are large, the fluctuation of air-fuel ratio sensor output in a cycle becomes large by the influence. In the air-fuel ratio feedback control of U.S. Pat. No. 6,397,830 B1, the variation among the cylinders is not considered. Even in a state where the variation among the cylinders is large, when the engine operation states are the same, the same control gain is set. Therefore, when the fluctuation of the air-fuel ratio sensor output becomes large by the influence of the variation among the cylinders, the fluctuation of an air-fuel ratio feedback correction amount becomes large in accordance with that. Thus, the stability of the air-fuel ratio feedback control is no ensured.

SUMMARY OF THE INVENTION

It is therefore an object of the present invention to provide an internal combustion engine control apparatus which can reduce or prevent the disturbance of feedback control due to variation among cylinders and can improve the stability of the feedback control.

In order to achieve the above object, an internal combustion engine control apparatus of the invention obtains a cylinder-by-cylinder variation value indicating variation in operation states among cylinders of an internal combustion engine, and decreases a control gain of feedback control or inhibits the feedback control when the cylinder-by-cylinder variation value exceeds a specified range. In this structure, when the feedback control is disturbed by the disturbance of the sensor output due to the cylinder-by-cylinder variation, the detected cylinder-by-cylinder variation value tends to exceed the specified range. In this instance, the control gain of the feedback control is lowered or the feedback control is inhibited, so that the disturbance of the feedback control due to the variation can be reduced or prevented, and the stability of the feedback control can be improved.

Besides, in a case of a system in which the variation in the operation states among the cylinders of the internal combustion engine is corrected on the basis of the variation value, since the cylinder-by-cylinder variation is still large until the cylinder-by-cylinder variation correction is completed, it is likely that the feedback control is disturbed.

Then, when the cylinder-by-cylinder variation correction is not completed, the control gain of the feedback control may be lowered or the feedback control may be inhibited. By doing so, when the cylinder-by-cylinder variation is large before the cylinder-by-cylinder variation correction is completed, the disturbance of the feedback control can be reduced or prevented so that the stability of the feedback control can be improved.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Various embodiments of the present invention will be described with reference to the accompanying drawing.

First Embodiment

Figure 1:
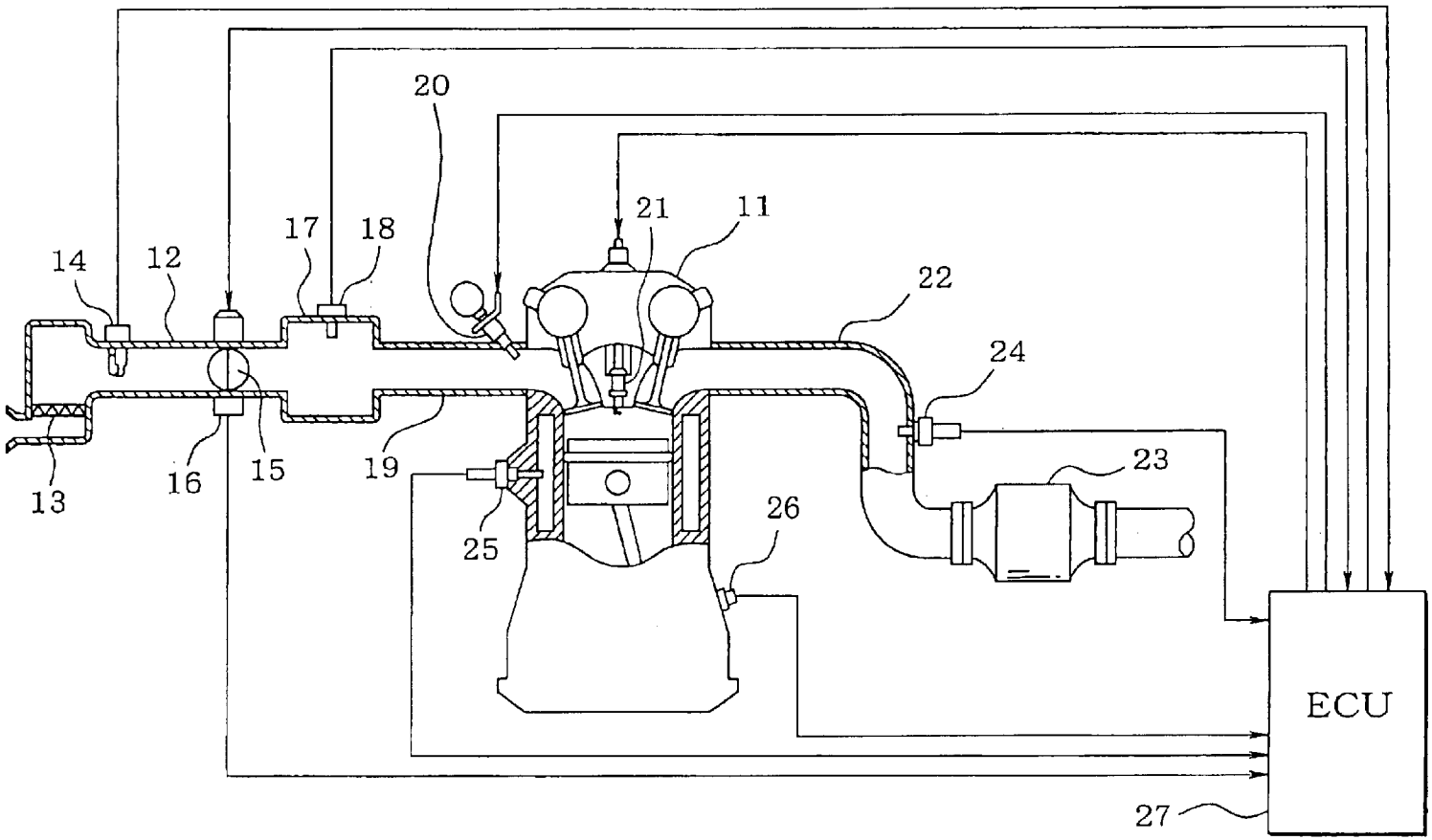
FIG. 1 is a schematic structural view of the whole engine control system in a first embodiment of the invention.

Referring first to FIG. 1, an internal combustion engine 11 includes four cylinders, the first cylinder #1 to the fourth cylinder #4. An air cleaner 13 is provided at the most upstream part of an intake pipe 12 of this engine 11, and an air flow meter 14 for detecting an intake air amount Q is provided at the downstream side of this air cleaner 13. A throttle valve 15 whose opening is adjusted by a DC motor or the like and a throttle opening sensor 16 for detecting the throttle opening are provided at the downstream side of this air flow meter 14.

Besides, a surge tank 17 is provided at the downstream side of the throttle valve 15, and an intake pipe pressure sensor 18 for detecting intake pipe pressure PM is provided in the surge tank 17. Besides, the surge tank 17 is provided with an intake manifold 19 for introducing air into the respective cylinders of the engine 11, and a fuel injection valve 20 for injecting fuel is attached to an intake port of the intake manifold 19 for each cylinder. Besides, in a cylinder head of the engine 11, an ignition plug 21 is attached for each cylinder, so that a mixture gas in the cylinder is ignited by spark discharge of the ignition plug 21.

A catalyst 23, such as a three-way catalyst, for purifying CO, HC, NOx and the like in exhaust gas is provided in an exhaust pipe 22 of the engine 11. An exhaust gas sensor 24 (air-fuel ratio sensor, oxygen sensor, etc.) for detecting an air-fuel ratio, lean/rich or the like of the exhaust gas, is provided at the upstream side of this catalyst 23. Besides, a water temperature sensor 25 for detecting cooling water temperature, and a crankshaft angle sensor 26 for outputting a pulse signal each time a crankshaft of the engine 11 rotates a specific crankshaft angle (for example, 30° CA) are attached to a cylinder block of the engine 11. A crankshaft angle CRNK and an engine rotation speed are detected on the basis of the output signal of this crankshaft angle sensor 26.

The outputs of these various sensors are inputted to an electronic control circuit (ECU) 27. This ECU 27 is principally constructed with a microcomputer, and executes various engine control programs stored in a built-in ROM (storage medium) to control the fuel injection amount of the fuel injection valve 20 and the ignition timing of the ignition plug 21 in accordance with the engine operation state.

The ECU 27 executes an air-fuel ratio feedback (F/B) control program, and calculates an air-fuel ratio F/B correction amount FAF by using a specified control gain ω (omega) so that a detected air-fuel ratio λs of the exhaust gas detected by the exhaust gas sensor 24 becomes equal to a target air-fuel ratio λtg. Further, the ECU executes a fuel injection amount calculation program, and calculates a fuel injection amount by using the air-fuel ratio F/B correction amount FAF to control the fuel injection amount of the fuel injection valve 20.

However, when the variation in the operation states among the cylinders is large, the fluctuation of the output of the exhaust gas sensor 24 in the cycle becomes large by the influence, and the fluctuation of the air-fuel ratio F/B correction amount FAF becomes large in accordance with that. In this case, the stability of the air-fuel ratio F/B control may be lost.

Figure 2:
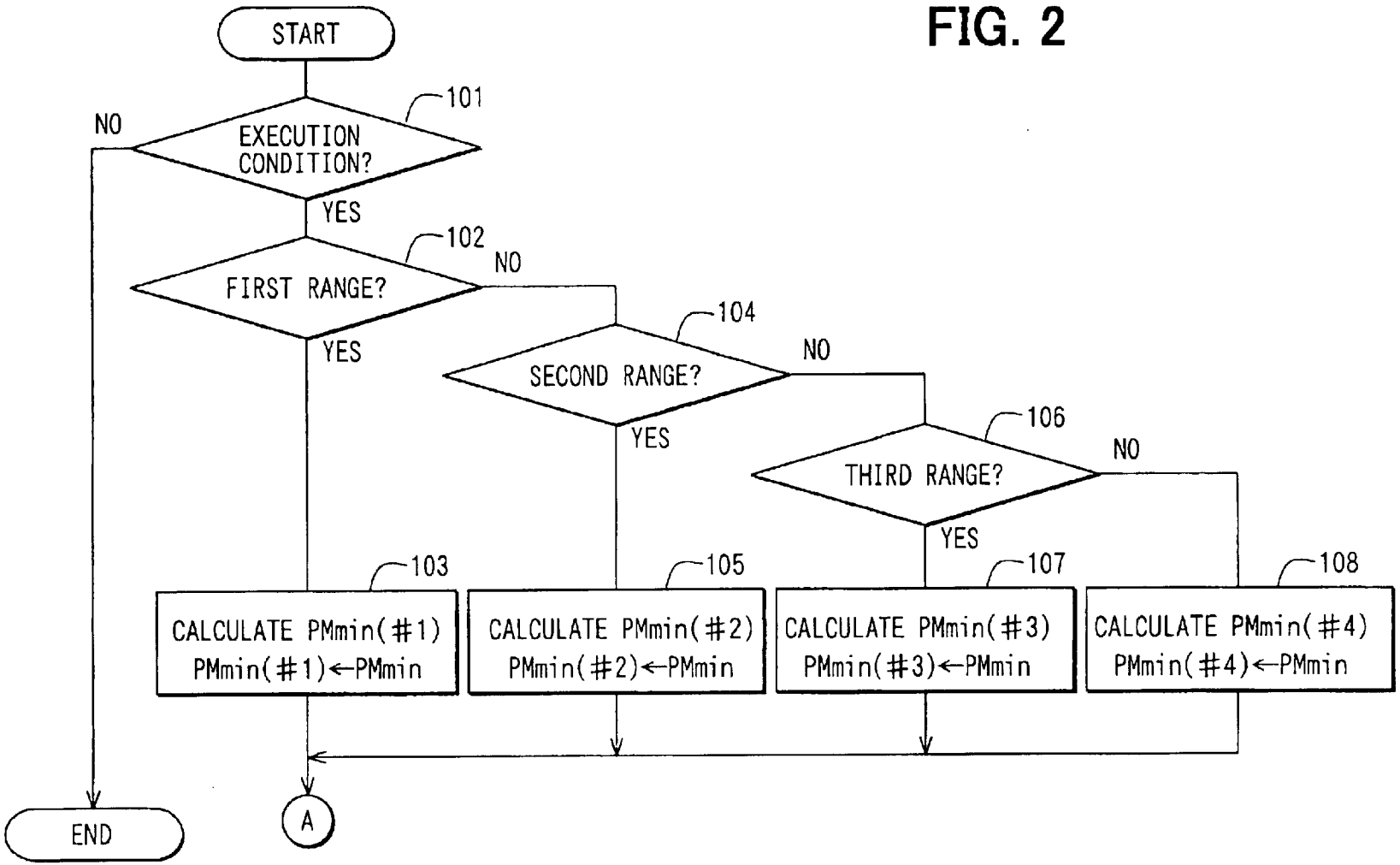
FIG. 2 is a flowchart (No. 1) showing the processing of a cylinder-by-cylinder variation detection of the first embodiment.
Figure 3:
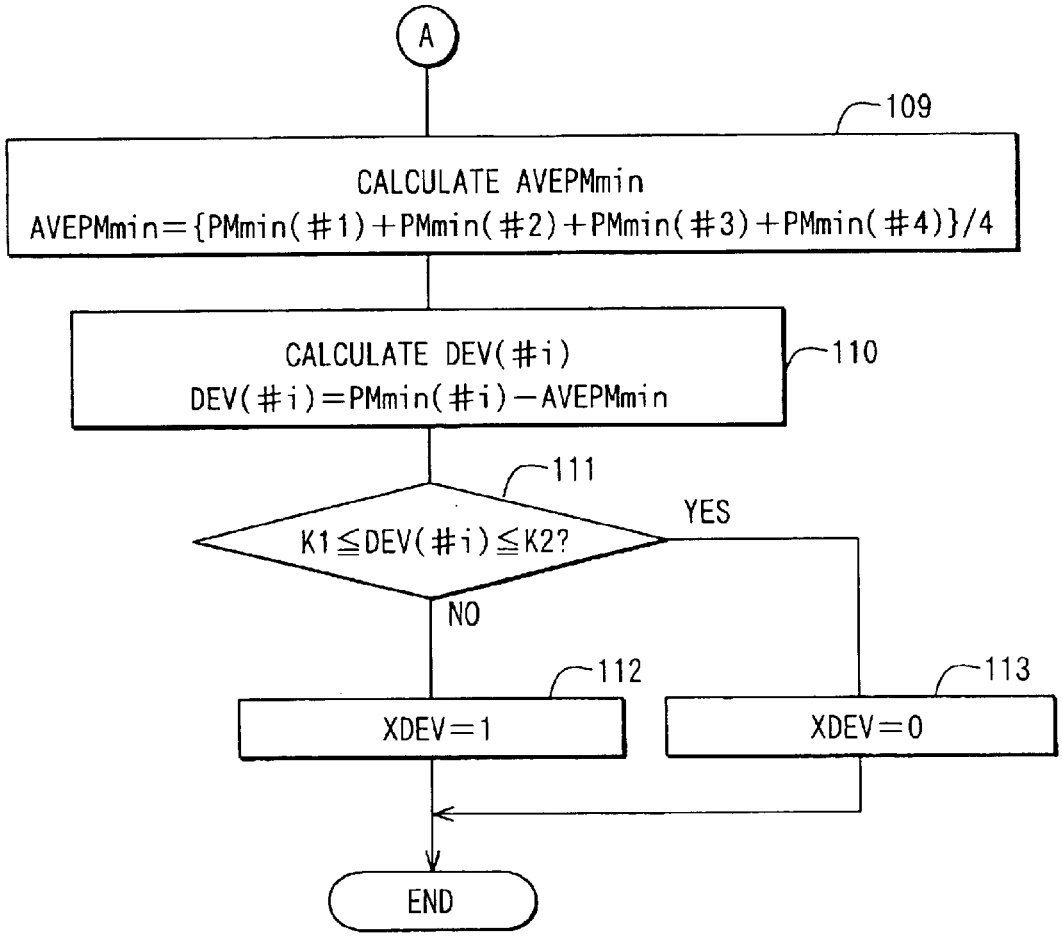
FIG. 3 is a flowchart (No. 2) showing the processing of the cylinder-by-cylinder variation detection of the first embodiment.
Figure 5:
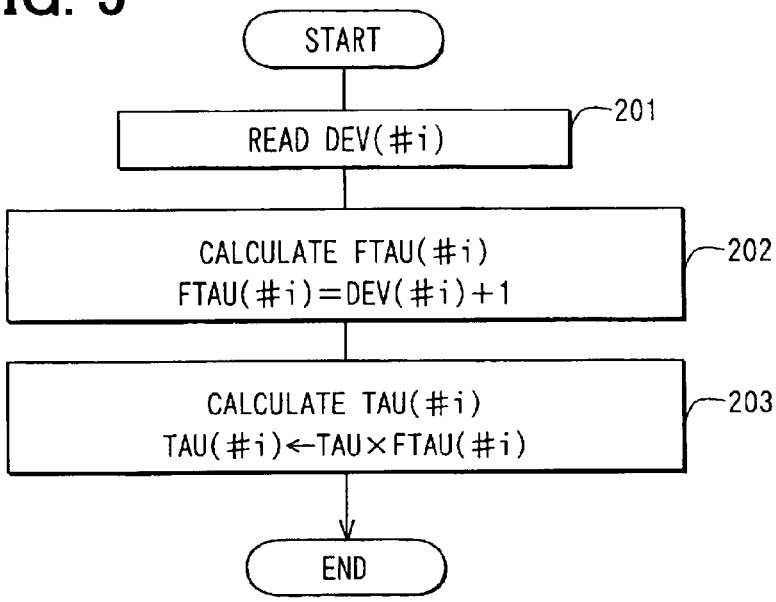
FIG. 5 is a flowchart showing the processing of a cylinder-by-cylinder variation correction of the first embodiment.

Therefore, the ECU 27 executes a cylinder-by-cylinder variation detection program shown in FIGS. 2 and 3 to calculate a cylinder-by-cylinder variation value DEV indicating the variation in the operation states among the cylinders of the engine 11, and executes a cylinder-by-cylinder variation correction program shown in FIG. 5 to correct the variation in the operation states among the cylinders of the engine 11 on the basis of the cylinder-by-cylinder variation value DEV.

Figure 6:
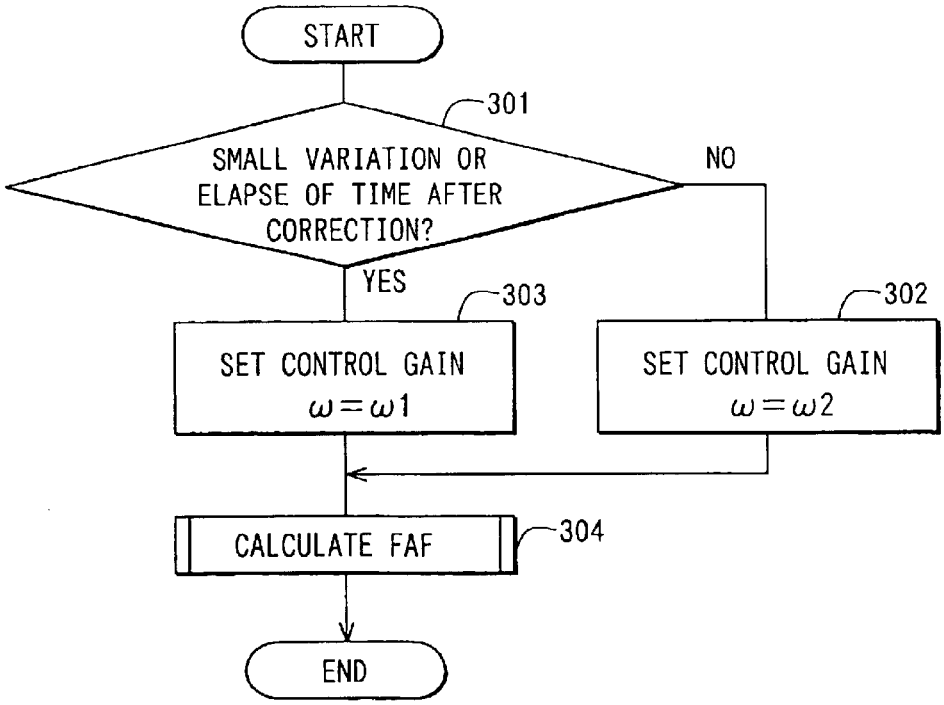
FIG. 6 is a flowchart showing the processing of an air-fuel ratio F/B correction amount calculation of the first embodiment.

When the air-fuel ratio F/B correction amount calculation program shown in FIG. 6 is executed to calculate the air-fuel ratio F/B correction amount FAF, and when the cylinder-by-cylinder variation value DEV exceeds a specified range or when the cylinder-by-cylinder variation correction is not completed, the control gain ω of the air-fuel ratio F/B control is made smaller than a normal one, so that the disturbance of the air-fuel ratio F/B control amount is reduced or prevented so that the air-fuel ratio F/B control is stabilized.

Hereinafter, the processing of the respective programs executed by the ECU 27 will be described.

[Cylinder-by-cylinder Variation Detection Program]

The cylinder-by-cylinder variation detection program shown in FIGS. 2 and 3 is executed, for example, in a specified cycle after an ignition switch (not shown) is turned on, and functions as cylinder-by-cylinder variation detection means.

Figure 4A:
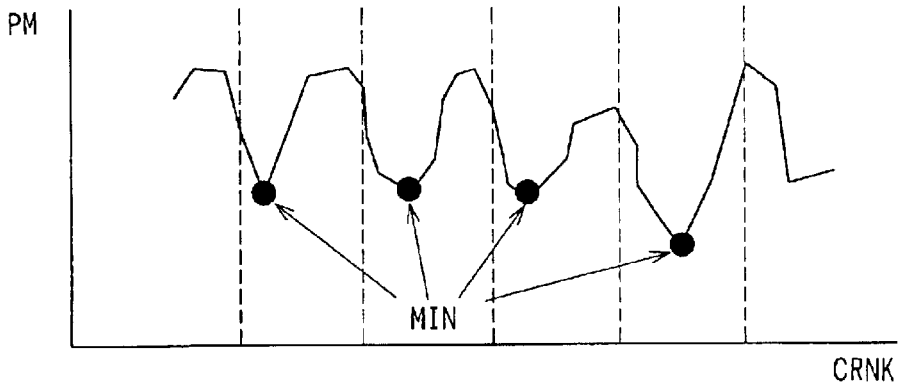
FIGS. 4A and 4B are time charts showing changes of an intake pipe pressure.
Figure 4B:
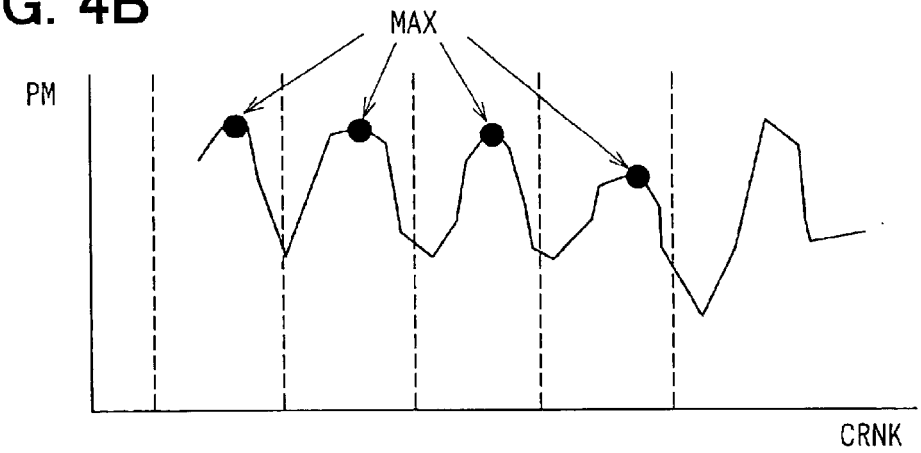

Here, as shown in FIGS. 4A and 4B, a waveform of the intake pipe pressure PM detected by the intake pipe pressure sensor 18 becomes a pulsating waveform reflecting the operation states (intake air amount, burning state, air-fuel ratio, etc.) of the respective cylinders. Accordingly, when characteristic values, such as a minimum value, a maximum value, an average value, an amplitude value, an area (integration value), a locus length and the like of the intake pipe pressure detected by the intake pipe pressure sensor 18, are calculated for each crankshaft angle range in which the influence of the respective cylinders appears, the characteristic values of the pulsation waveform reflecting the operation states of the respective cylinders can be calculated. Therefore, when the characteristic values are used, a cylinder-by-cylinder variation value reflecting the variation in the operation states of the respective cylinders can be calculated.

In this program, since the cylinder-by-cylinder variation value is calculated by using the minimum value of the intake pipe pressure, as shown in FIG. 4A, the first to fourth crankshaft angle ranges are set so as to respectively include regions where the intake pipe pressure PM comes to have the minimum values by the influence of the first to the fourth cylinders.

When this program is started, first, at step 101, it is checked whether or not an execution condition of cylinder-by-cylinder variation detection is established on the basis of, for example, whether a steady state (not a transient state) occurs. When it is determined that the execution condition of the cylinder-by-cylinder variation detection is not established, the subsequent processing is not performed, and this program is ended.

In the case where it is determined at step 101 that the execution condition of the cylinder-by-cylinder variation detection program is established, the processing proceeds to step 102, and it is checked whether or not a crankshaft angle CRNK detected on the basis of the output signal of the crankshaft angle sensor 26 is within a first crankshaft angle range, i.e., crankshaft angle range including a region where the intake pipe pressure PM comes to have the minimum value by the influence of the first cylinder #1.

As a result, when it is determined that the crankshaft angle is within the first crankshaft angle range, the processing proceeds to step 103, the minimum value PMmin of the intake pipe pressure within the first crankshaft angle range is calculated as the intake pipe pressure minimum value PMmin(#1) of the first cylinder #1.

On the other hand, at step 102, in the case where it is determined that the crankshaft angle is not within the first crankshaft angle range, the processing proceeds to step 104, and it is checked whether or not the crankshaft angle is within a second crankshaft angle range, i.e., crankshaft angle range including a region where the intake pipe pressure comes to have the minimum value by the influence of the second cylinder #2. As a result, when it is determined that the crankshaft angle is within the second crankshaft angle range, the processing proceeds to step 105, and the minimum value PMmin of the intake pipe pressure within the second crankshaft angle range is calculated as the intake pipe pressure minimum value PMmin(#2) of the second cylinder #2.

Besides, at step 104, in the case where it is determined that the crankshaft angle is not within the second crankshaft angle range, the processing proceeds to step 106, and it is checked whether or not the crankshaft angle is within a third crankshaft angle range, i.e., crankshaft angle range including a region where the intake pipe pressure comes to have the minimum value by the influence of the third cylinder #3. As a result, when it is determined that the crankshaft angle is within the third crankshaft angle range, the processing proceeds to step 107, and the minimum value PMmin of the intake pipe pressure within the third crankshaft angle range is calculated as the intake pipe pressure minimum value PMmin (#3) of the third cylinder.

Besides, at step 106, in the case where it is determined that the crankshaft angle is not within the third crankshaft angle range, it is determined that the crankshaft angle is within a fourth crankshaft angle range, i.e., crankshaft angle range including a region where the intake pipe pressure comes to have the minimum value by the influence of the fourth cylinder #4, the processing proceeds to step 108, and the minimum value PMmin of the intake pipe pressure within the fourth crankshaft angle range is calculated as the intake pipe pressure minimum value PMmin(#4) of the fourth cylinder #4.

Thereafter, the processing proceeds to step 109 (FIG. 3), and an average value AVEPMmin of the intake pipe pressure minimum values PMmin(#1) to PMmin(#4) of all the cylinders is calculated.

$$AVEPM\min=\{PM\min(\#1)+\ldots+PM\min(\#4)\}/4$$

Thereafter, the processing proceeds to step 110, and a cylinder-by-cylinder variation value DEV(#i) of each of the cylinders is calculated by a following expression using the intake pipe pressure minimum value PMmin(#i) of each of the cylinders and the average value AVEPMmin. Here, #i=#1 to #4.

$$DEV(\#i)=PM\min(\#i)-AVEPM\min$$

Thereafter, the processing proceeds to step 111, and it is checked whether or not the cylinder-by-cylinder variation value DEV(#i) of each of the cylinders is within a specified range ($K1 \leqq DEV(\#i) \leqq K2$). As a result, in the case where it is determined that even one of all the cylinder-by-cylinder variation values DEV(#1) to DEV(#4) is outside of the specified range, the processing proceeds to step 112, a cylinder-by-cylinder variation flag XDEV is set to "1" meaning that the cylinder-by-cylinder variation is large.

On the other hand, in the case where it is determined that all the cylinder-by-cylinder variation values DEV(#1) to DEV(#4) are within the specified range, the processing proceeds to step 113, the cylinder-by-cylinder variation flag XDEV is reset to "0" meaning that the cylinder-by-cylinder variation is small.

[Cylinder-by-cylinder Variation Correction Program]

The cylinder-by-cylinder variation correction program shown in FIG. 5 is executed, for example, in a specified cycle after the ignition switch is turned on, and functions as cylinder-by-cylinder variation correction means. When this program is started, first, after the cylinder-by-cylinder variation value DEV(#i) of each of the cylinders is read at step 201, the processing proceeds to step 202, and a fuel injection time correction coefficient FTAU(#i) of each of the cylinders is calculated by using the cylinder-by-cylinder variation value DEV(#i) of each of the cylinders and by the following expression.

$$FTAU(\#i)=DEV(\#i)+1$$

Thereafter, the processing proceeds to step 203, and a final fuel injection time TAU(#i) of each of the cylinders is obtained by multiplying an average fuel injection time TAU of all the cylinders before correction by the fuel injection time correction coefficient FTAU(#i) of each of the cylinders.

$$TAU(\#i)=TAU\times FTAU(\#i)$$

From the above processing, the fuel injection amount TAU of each of the cylinders is corrected in accordance with the cylinder-by-cylinder variation value DEV(#i) of each of the cylinders, so that the air-fuel ratio variation among the cylinders is decreased.

[Air-fuel Ratio F/B Correction Amount Calculation Program]

The air-fuel ratio F/B correction amount calculation program shown in FIG. 6 is executed, for example, at each time of fuel injection, and functions as feedback control means. When this program is started, first, at step 301, (1) it is checked whether or not the variation among the cylinders is small (cylinder-by-cylinder variation flag XDEV=0), and (2) it is checked whether or not a specified period (specified time, specified crankshaft angle, etc.) has elapsed since the cylinder-by-cylinder variation correction has been completed.

As a result, in the case where it is determined that the cylinder-by-cylinder variation is large (cylinder-by-cylinder variation flag XDEV=1), or in the case where it is determined that the specified period has not passed since the cylinder-by-cylinder variation correction was completed, it is determined that there is a possibility that the output of the exhaust gas sensor 24 is disturbed by the cylinder-by-cylinder variation and the air-fuel ratio feedback (A/F F/B) correction amount FAF is disturbed. The processing proceeds to step 302, and the control gain ω of the air-fuel ratio F/B control is changed to a value ω2 smaller than a normal value ω1. Thus, even if the output of the exhaust gas sensor 24 is disturbed by the cylinder-by-cylinder variation, the disturbance of the air-fuel ratio F/B correction amount FAF is reduced or prevented. The processing of this step 302 functions as control stabilization means.

On the other hand, at step 301, in the case where it is determined that the cylinder-by-cylinder variation is small, or in the case where it is determined that the specified period has passed since the cylinder-by-cylinder variation correction has been completed, the processing proceeds to step 303, and the control gain ω of the air-fuel ratio F/B control is returned to the normal value ω1.

In this way, after the control gain ω is set at step 302 or 303, the processing proceeds to step 304, and the air-fuel ratio F/B correction amount FAF is calculated using the control gain ω so that the detected air-fuel ratio λs becomes equal to the target air-fuel ratio λtg.

In the first embodiment described above, when the cylinder-by-cylinder variation is large, the control gain ω of the air-fuel ratio F/B control is changed to the value ω2 smaller than the normal value. Therefore, even if the output of the exhaust gas sensor 24 is disturbed by the cylinder-by-cylinder variation, it is possible to reduce or prevent the disturbance of the air-fuel ratio F/B correction amount FAF, and the stability of the air-fuel ratio F/B control can be improved.

Besides, in the first embodiment, consideration is given to a fact that some time may be taken until the cylinder-by-cylinder variation becomes actually sufficiently small from the execution of the cylinder-by-cylinder variation correction, and even after the cylinder-by-cylinder variation correction was completed, until the specified period passes, the processing of causing the control gain ω of the air-fuel ratio F/B control to be smaller than the normal value is continued. Accordingly, even in the period immediately after the cylinder-by-cylinder variation correction is completed and when there is a possibility that the cylinder-by-cylinder variation does not become sufficiently small, the processing of lowering the control gain ω of the air-fuel ratio F/B control is performed, and the disturbance of the air-fuel ratio F/B control can be reduced or prevented without fail.

However, it is not always necessary to continue the processing of lowering the control gain ω of the air-fuel ratio F/B control until the specified period has passed since the cylinder-by-cylinder variation correction was completed. In the case where the cylinder-by-cylinder variation is quickly lowered by the cylinder-by-cylinder variation correction, immediately after the cylinder-by-cylinder variation correction is completed, the control gain ω of the air-fuel ratio F/B control may be immediately returned to the normal value ω1.

Second Embodiment

Figure 7:
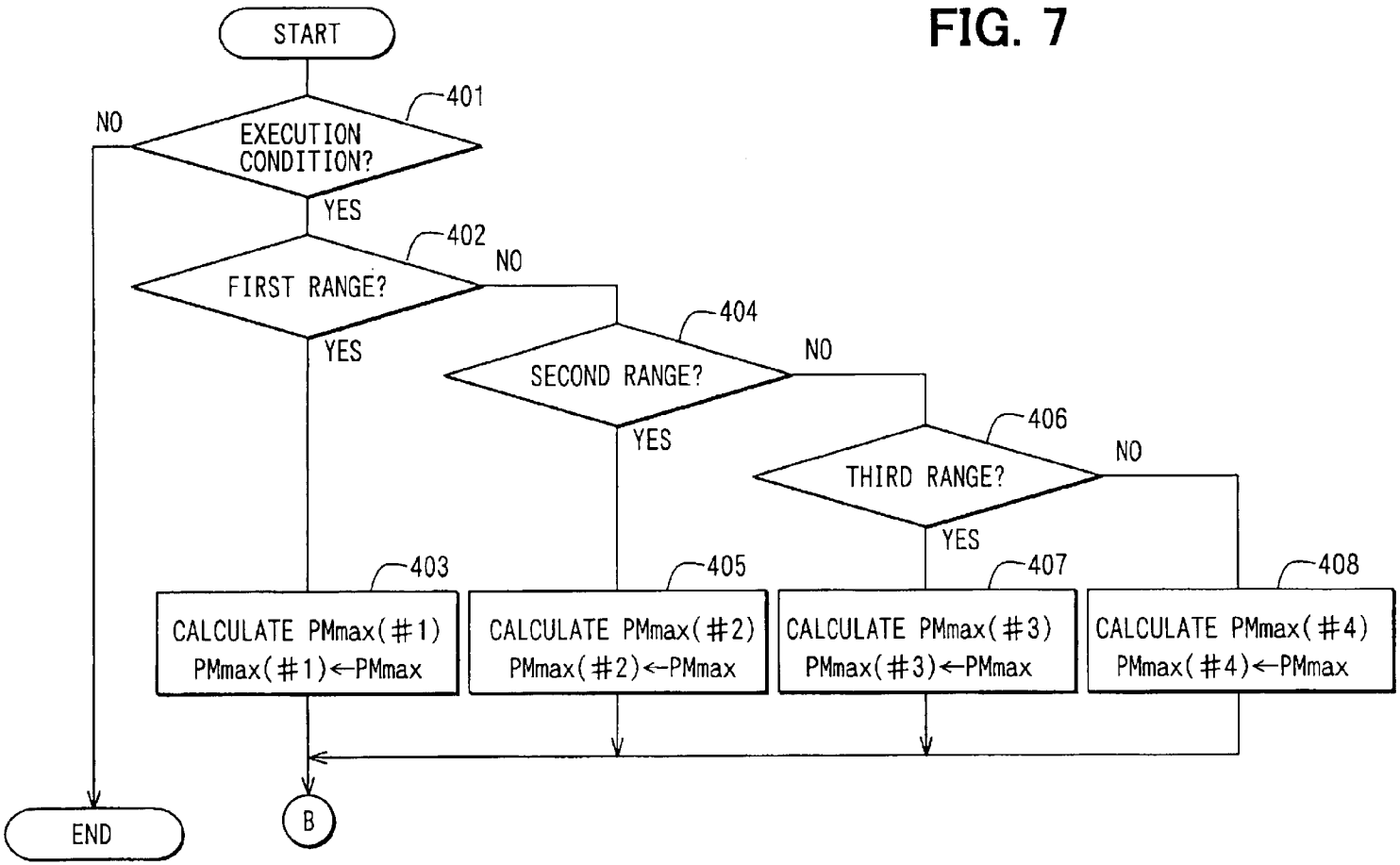
FIG. 7 is a flowchart (No. 1) showing the processing of a cylinder-by-cylinder variation detection of a second embodiment.
Figure 8:
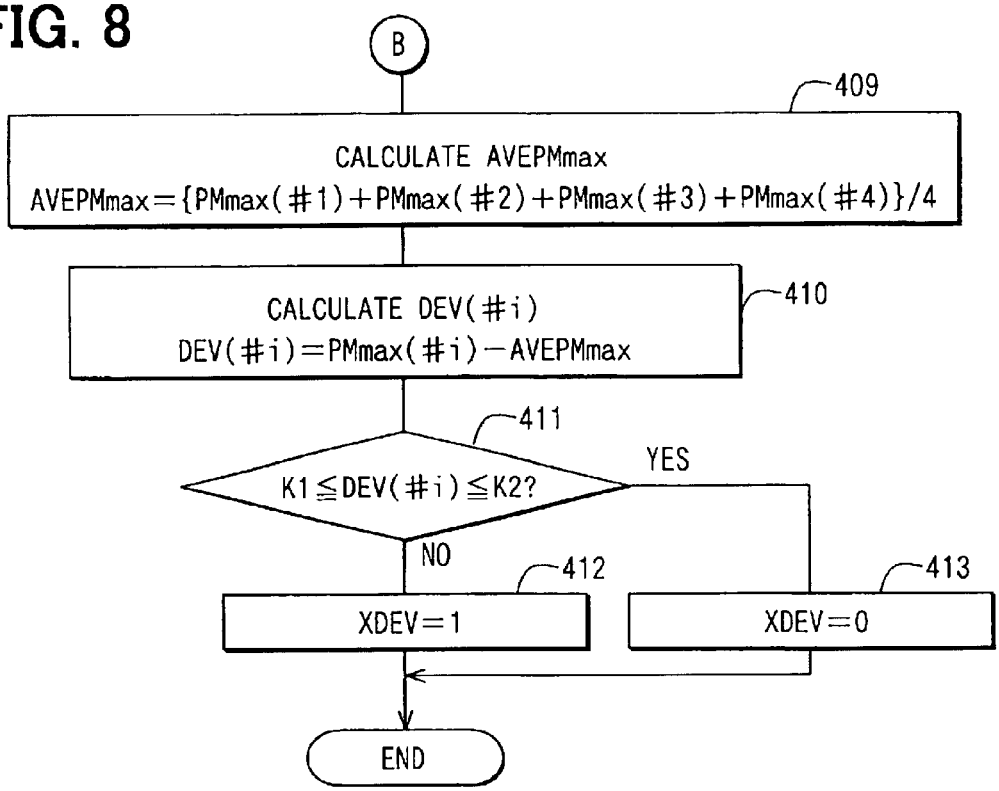
FIG. 8 is a flowchart (No. 2) showing the processing of the cylinder-by-cylinder variation detection of the second embodiment.

In the second embodiment of the invention, a cylinder-by-cylinder variation detection program shown in FIGS. 7 and 8 is executed so that the cylinder-by-cylinder variation value is calculated by using the maximum value of the intake pipe pressure.

[Cylinder-by-cylinder Variation Detection Program]

In the cylinder-by-cylinder variation detection program shown in FIGS. 7 and 8, since the cylinder-by-cylinder variation is calculated by using the maximum value of the intake pipe pressure, as shown in FIG. 4B, the first to fourth crankshaft angle ranges are set to respectively include regions where the intake pipe pressure comes to have the maximum values by the influence of the first to the fourth cylinders.

In this program, at step 401, in the case where it is determined that an execution condition of cylinder-by-cylinder variation detection is established, when a crankshaft angle is within the first crankshaft angle range, i.e., crankshaft angle range including a region where the intake pipe pressure comes to have the maximum value by the influence of the first cylinder #1, the maximum value PMmax of the intake pipe pressure within the first crankshaft angle range is calculated as the intake pipe pressure maximum value PMmax(#1) of the first cylinder #1 (steps 402 and 403).

On the other hand, when the crankshaft angle is within the second crankshaft angle range, i.e., crankshaft angle range including a region where the intake pipe pressure comes to have the maximum value by the influence of the second cylinder #2, the maximum value PMmax of the intake pipe pressure within the second crankshaft angle range is calculated as the intake pipe pressure maximum value PMmax (#2) of the second cylinder #2 (steps 404 and 405).

Besides, when the crankshaft angle is within the third crankshaft angle range, i.e., crankshaft angle range including a region where the intake pipe pressure comes to have the maximum value by the influence of the third cylinder #3, the maximum value PMmax of the intake pipe pressure within the third crankshaft angle range is calculated as the intake pipe pressure maximum value of the third cylinder #3 (steps 406 and 407).

Besides, when the crankshaft angle is within a fourth crankshaft angle range, i.e., crankshaft angle range including a region where the intake pipe pressure comes to have the maximum value by the influence of the fourth cylinder #4), the maximum value PMmax of the intake pipe pressure within the fourth crankshaft angle range is calculated as the intake pipe pressure maximum value of the fourth cylinder #4 (step 408).

Thereafter, the processing proceeds to step 409 of FIG. 8, and an average value AVEPMmax of the intake pipe pressure maximum values PMmax(#1) to PMmax(#4) of all the cylinders is calculated.

$$AVEPM\max=\{PM\max(\#1)+\ldots+PM\max(\#4)\}/4$$

Thereafter, the processing proceeds to step 410, and the intake pipe pressure maximum value PMmax(#i) of each of the cylinders and the average value AVEPMmax are used and a cylinder-by-cylinder variation value DEV(#i) of each of the cylinders is calculated by the following expression.

$$DEV(\#i)=PM\max(\#i)-AVEPM\max$$

Thereafter, the processing proceeds to step 411. It is checked whether or not the cylinder-by-cylinder variation value DEV(#i) of each of the cylinders is within a specified range ($K1 \leqq DEV(\#i) \leqq K2$). In the case where it is determined that even one of all the cylinder-by-cylinder variation values DEV(#1) to DEV(#4) is outside of the specified range, the processing proceeds to step 412, a cylinder-by-cylinder variation flag XDEV is set to "1." In the case where it is determined that all the cylinder-by-cylinder variation values DEV(#1) to DEV(#4) are within the specified range, the processing proceeds to step 413, and the cylinder-by-cylinder variation flag XDEV is reset to "0".

Also according to the second embodiment, the cylinder-by-cylinder variation value DEV(#i) of each of the cylinders can be obtained with high accuracy.

Third Embodiment

Figure 9:
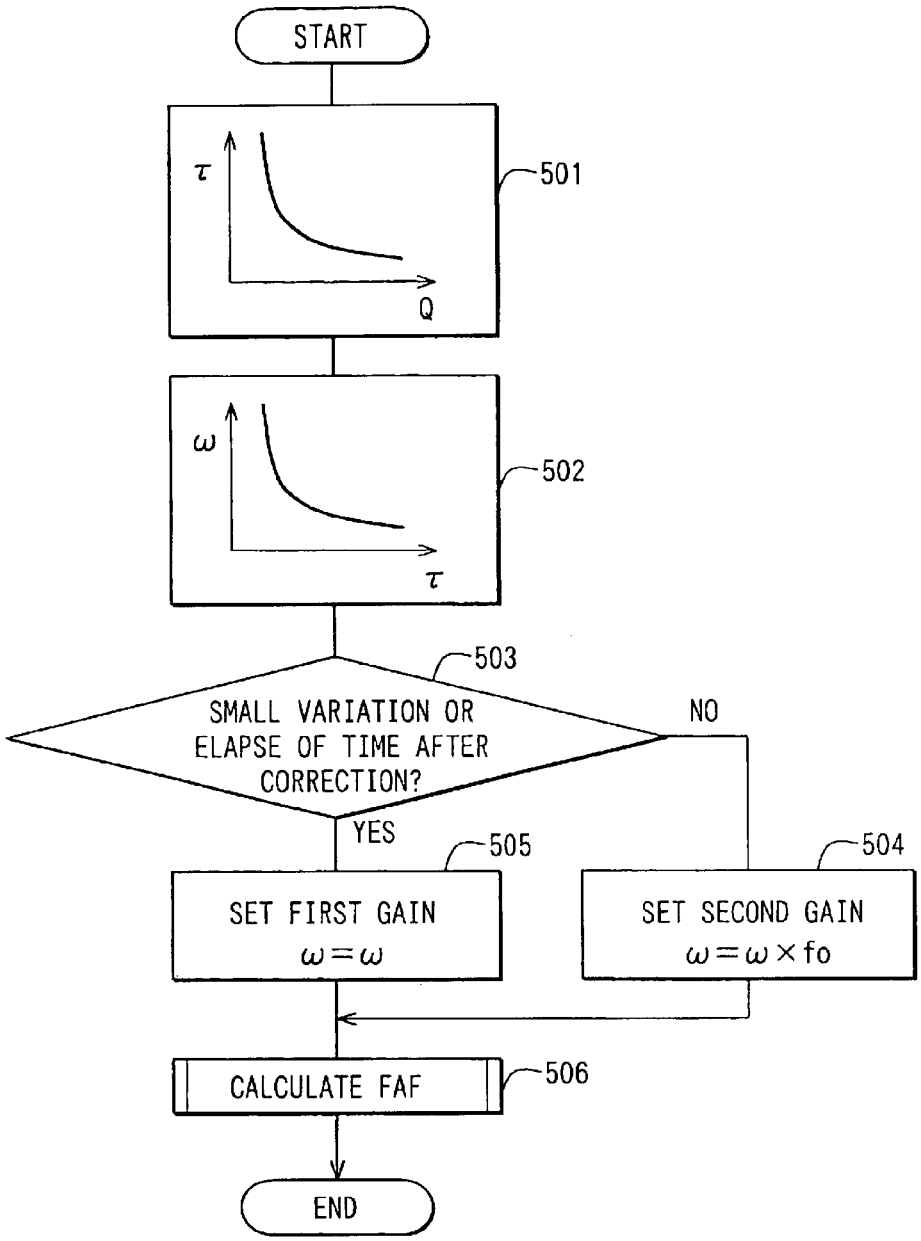
FIG. 9 is a flowchart showing the processing of an air-fuel ratio F/B correction amount calculation of a third embodiment.

In the third embodiment, an air-fuel ratio feedback (A/F F/B) correction amount calculation program shown in FIG. 9 is executed by using an air-fuel ratio control model simulating a control object from the fuel injection valve 20 to the exhaustion gas sensor 24. An air-fuel ratio F/B correction amount FAF is calculated by using a specified control gain ω so that a detection air-fuel ratio λs of the exhaust gas detected by the exhaust gas sensor 24 becomes equal to a target air-fuel ratio λtg. At this time, when a cylinder-by-cylinder variation value DEV exceeds a specified range, or when cylinder-by-cylinder variation correction is not completed, the control gain ω is made smaller than a normal one, so that the disturbance of the air-fuel ratio F/B correction amount is reduced or prevented, thus stabilizing the air-fuel ratio F/B control.

In the air-fuel ratio F/B correction amount calculation program shown in FIG. 9, first, at step 501, a response time constant τ of the air-fuel ratio control model corresponding to the present engine operation state (for example, intake air amount) is calculated by using a map or a mathematical expression of the response time constant τ of the air-fuel ratio control model. The map or the mathematical expression of the response time constant τ of the air-fuel ratio control model is previously set by an experiment, simulation or the like and is stored in the ROM of the ECU 27.

Thereafter, the processing proceeds to step 502, and a control gain ω corresponding to the time constant τ of the air-fuel ratio control model is calculated by using a map or a mathematical expression of the control gain ω. The map or the mathematical expression of this control gain ω is previously set by an experiment, simulation or the like and is stored in the ROM of the ECU 27.

Thereafter, the processing proceeds to step 503, and (1) it is checked whether or not the cylinder-by-cylinder variation is small (cylinder-by-cylinder variation flag XDEV=0) and (2) it is checked whether or not the cylinder-by-cylinder variation correction is completed.

As a result, in the case where it is determined that the cylinder-by-cylinder variation is large (cylinder-by-cylinder variation flag XDEV=1), or in the case where it is determined that the cylinder-by-cylinder variation correction is not completed, it is determined that there is a possibility that the output of the exhaust gas sensor 24 is disturbed by the cylinder-by-cylinder variation and the air-fuel ratio F/B correction amount FAF is disturbed, the processing proceeds to step 504. The control gain ω is corrected by multiplying the control gain ω calculated in accordance with the engine operation state by a correction coefficient f0 (0<f0<1), so that the control gain ω is changed to a value smaller than a normal one.

$$\omega=\omega\times f0$$

On the other hand, at step 503, in the case where it is determined that the cylinder-by-cylinder variation is small, or in the case where it is determined that the cylinder-by-cylinder variation correction is completed, the processing proceeds to step 505, and the control gain ω calculated in accordance with the engine operation state is adopted as it is.

After the control gain ω is set at step 504 or 505 in the manner as described above, the processing proceeds to step 506. In this step, by using the response time constant τ of the air-fuel ratio control model, the control gain ω, an attenuation coefficient ζ, a deviation Δλ between the detection air-fuel ratio λs and the target air-fuel ratio λtg, and the like are used, the air-fuel ratio F/B correction amount FAF is calculated according to a calculation expression of the air-fuel ratio F/B correction amount FAF derived from the air-fuel ratio control model so that the detection air-fuel ratio λs becomes equal to the target air-fuel ratio λtg.

Method of calculation of the air-fuel ratio F/B correction amount using the air-fuel ratio control model is disclosed in, for example, U.S. Pat. No. 6,397,830, in detail.

In the third embodiment, since the control gain ω is changed in accordance with the engine operation state, while the stability of the air-fuel ratio F/B control is secured in all the operation regions, the responsibility of the air-fuel ratio F/B control over the change of the engine operation state can be improved. Further, when the cylinder-by-cylinder variation is large or the cylinder-by-cylinder variation correction is not completed, the control gain ω of the air-fuel ratio F/B control is changed to the value smaller than the normal value. Therefore, even if the output of the exhaust gas sensor 24 is disturbed by the cylinder-by-cylinder variation, it is possible to reduce or prevent the disturbance of the air-fuel ratio F/B correction amount FAF, and the stability of the air-fuel ratio F/B control can be improved.

In the third embodiment, similarly to the first embodiment, even after the cylinder-by-cylinder variation correction is completed, the processing of lowering the control gain ω of the air-fuel ratio F/B control may be continued until a specified period passes.

Fourth Embodiment

Figure 10:
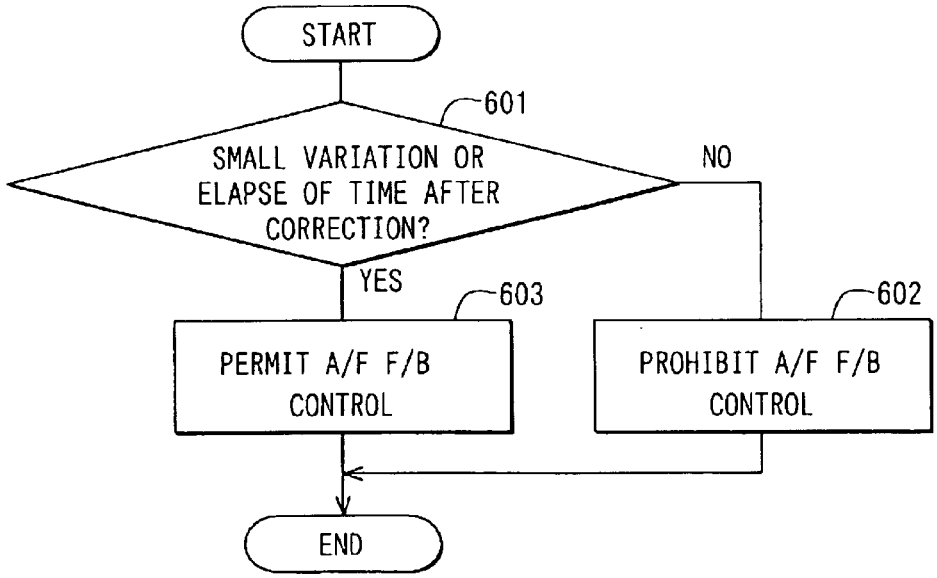
FIG. 10 is a flowchart showing the processing of a control stabilization of a fourth embodiment.

In the fourth embodiment of the invention, a control stabilization program shown in FIG. 10 is executed. Specifically, when the cylinder-by-cylinder variation is large, the air-fuel ratio FIB control is inhibited, so that the air-fuel ratio control is stabilized.

[Control Stabilization Program]

In the control stabilization program shown in FIG. 10, first, at step 601, (1) it is checked whether or not the cylinder-by-cylinder variation is small (cylinder-by-cylinder variation flag XDEV=0), and (2) it is checked whether or not the cylinder-by-cylinder variation correction is completed.

As a result, in the case where it is determined that the cylinder-by-cylinder variation is large (cylinder-by-cylinder variation flag XDEV=1), or in the case where it is determined that the cylinder-by-cylinder variation correction is not completed, it is determined that there is a possibility that the air-fuel ratio F/B correction amount FAF is disturbed, when the air-fuel-ratio F/B control is executed. This is because the output of the exhaust gas sensor 24 is disturbed by the cylinder-by-cylinder variation. Therefore, the processing proceeds to step 602, and the air-fuel ratio F/B control is inhibited (for example, the air-fuel ratio F/B correction amount FAF is fixed to a standard value) for all the cylinders to execute an open-loop control.

On the other hand, at step 601, in the case where it is determined that the cylinder-by-cylinder variation is small, or in the case where it is determined that the cylinder-by-cylinder variation correction is completed, the processing proceeds to step 603 and the air-fuel ratio F/B control is allowed.

In the fourth embodiment as described above, when the cylinder-by-cylinder variation is large or the cylinder-by-cylinder variation correction is not completed, the air-fuel ratio F/B control is inhibited. Therefore, even if the output of the exhaust gas sensor 24 is disturbed by the cylinder-by-cylinder variation, the stability of the air-fuel ratio control can be improved.

Even after the cylinder-by-cylinder variation correction is completed, the processing of inhibiting the air-fuel ratio F/B control may be continued until a specified period passes.

Fifth Embodiment

Figure 11:
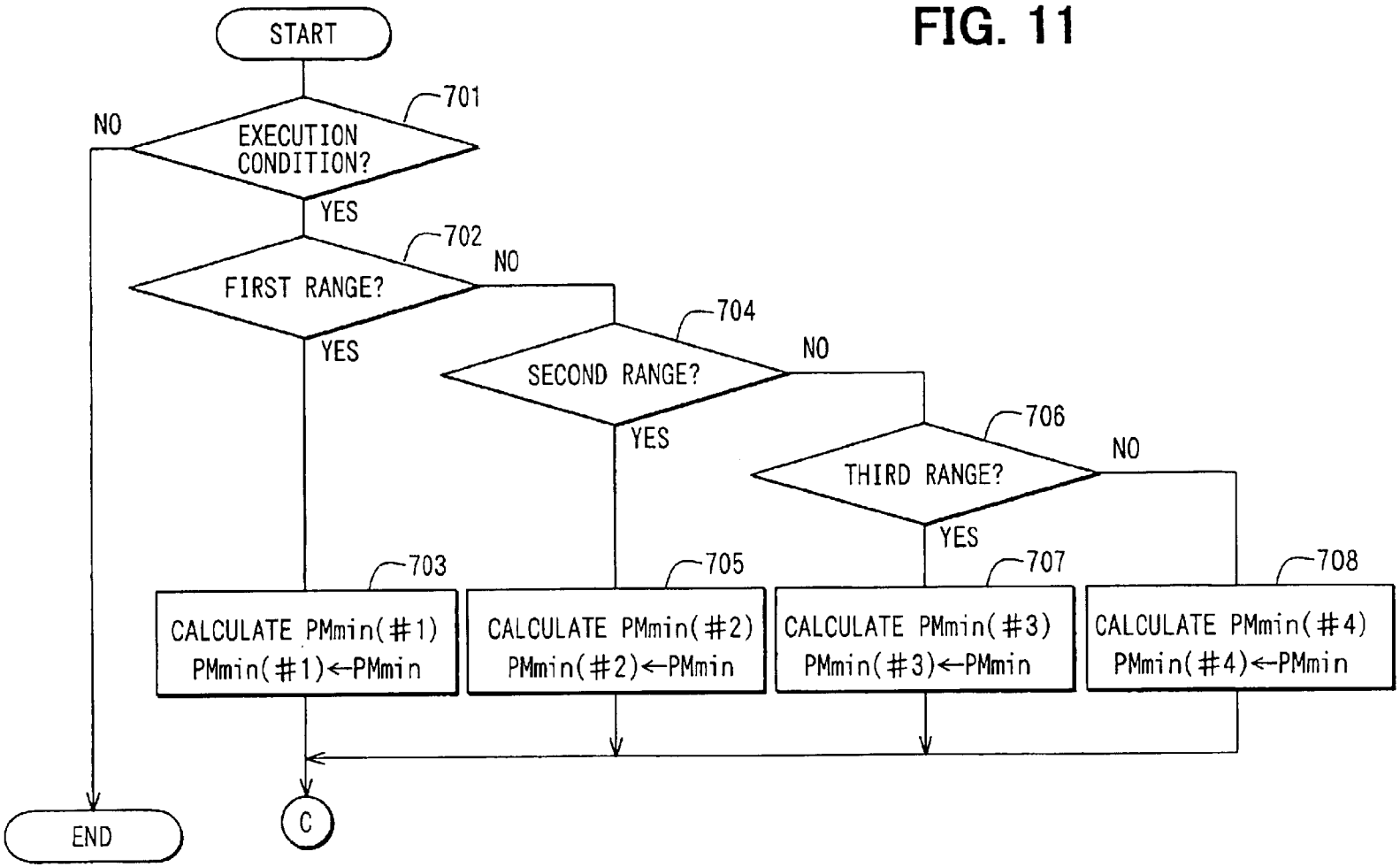
FIG. 11 is a flowchart (No. 1) showing the processing of a cylinder-by-cylinder variation detection and control stabilization.
Figure 12:
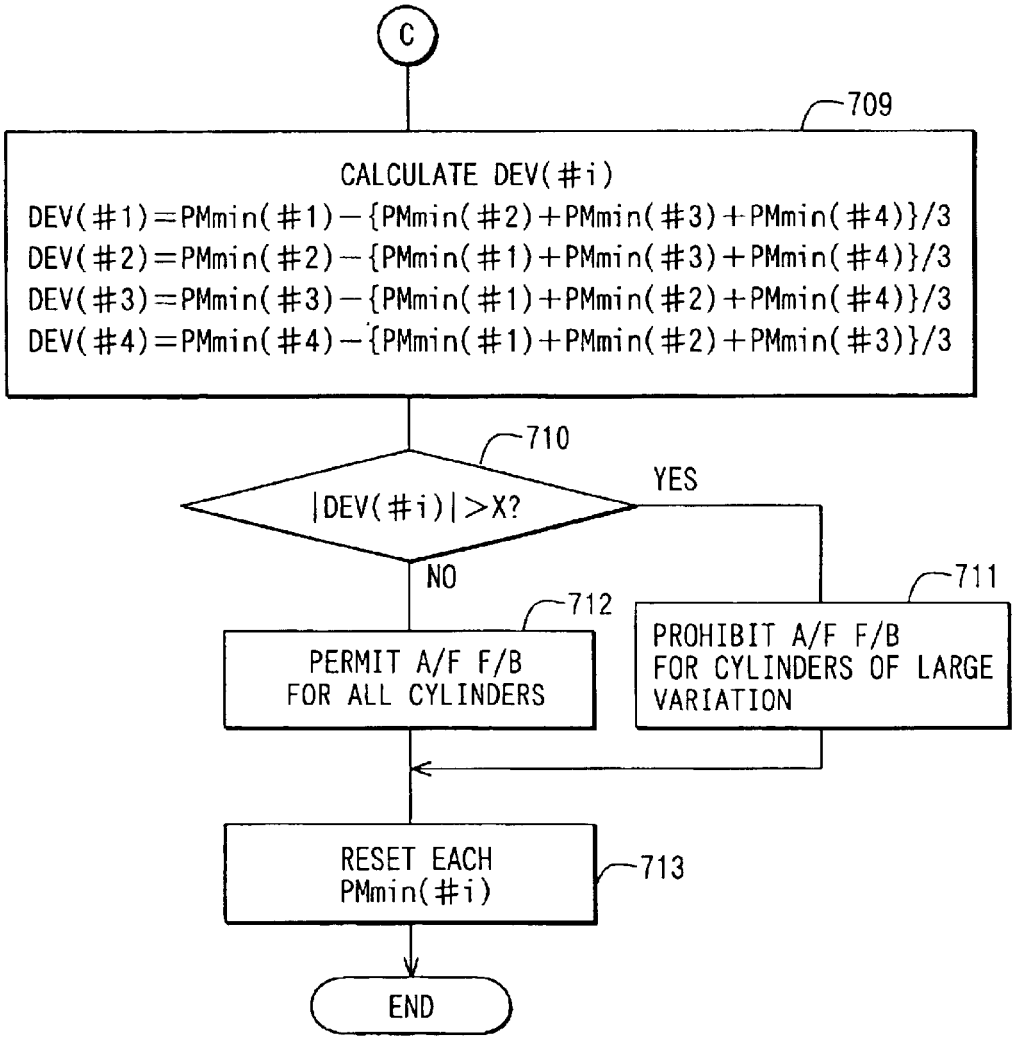
FIG. 12 is a flowchart (No. 2) showing the processing of the cylinder-by-cylinder variation detection and control stabilization.

In the fifth embodiment of the invention, a cylinder-by-cylinder variation detection and control stabilization program shown in FIGS. 11 and 12 is executed, so that the air-fuel ratio F/B control is inhibited for only the cylinder in which the cylinder-by-cylinder variation is large.

[Cylinder-by-cylinder Variation Detection and Control Stabilization Program]

In the cylinder-by-cylinder variation detection and control stabilization program shown in FIGS. 11 and 12, in the case where it is determined at step 701 that the execution condition of the cylinder-by-cylinder variation detection is established, when a crankshaft angle is within the first crankshaft angle range, i.e., crankshaft angle range including a region where the intake pipe pressure comes to have the minimum value by the influence of the first cylinder #1, the minimum value PMmin of the intake pipe pressure within the first crankshaft angle range is calculated as the intake pipe pressure minimum value PMmin(#1) of the first cylinder #1 (steps 702 and 703).

On the other hand, when the crankshaft angle is within the second crankshaft angle range, i.e., crankshaft angle range including a region where the intake pipe pressure comes to have the minimum value by the influence of the second cylinder #2, the minimum value PMmin of the intake pipe pressure within the second crankshaft angle range is calculated as the intake pipe pressure minimum value PMmin(#2) of the second cylinder #2 (steps 704 and 705).

Besides, when the crankshaft angle is within the third crankshaft angle range, i.e., crankshaft angle range including a region where the intake pipe pressure comes to have the minimum value by the influence of the third cylinder #3, the minimum value PMmin of the intake pipe pressure within the third crankshaft angle range is calculated as the intake pipe pressure minimum value PMmin(#3) of the third cylinder #3 (steps 706 and 707).

Besides, when the crankshaft angle is within the fourth crankshaft angle range, i.e., crankshaft angle range including a region where the intake pipe pressure comes to have the minimum value by the influence of the fourth cylinder #4, the minimum value PMmin of the intake pipe pressure within the fourth crankshaft angle range is calculated as the intake pipe pressure minimum value PMmin(#4) of the fourth cylinder #4 (step 708).

Thereafter, the processing proceeds to step 709 of FIG. 12, and a cylinder-by-cylinder variation value DEV(#i) of each of the cylinders is calculated by using the intake pipe pressure minimum value PMmin(#i) of each of the cylinders. In the fifth embodiment, in the case where the cylinder-by-cylinder variation value DEV(#j) of the j-th cylinder #j is obtained, a deviation between the intake pipe pressure minimum value PMmin(#j) of the j-th cylinder #j and an average value of the intake pipe pressure minimum values of the cylinders other than the j-th cylinder #j is obtained, and it is made the cylinder-by-cylinder variation value DEV(#j) of the j-th cylinder #j.

$$DEV(\#1)=PM\min(\#1)-\{PM\min(\#2)+PM\min(\#3)+PM\min(\#4)\}/3$$

$$DEV(\#2)=PM\min(\#2)-\{PM\min(\#1)+PM\min(\#3)+PM\min(\#4)\}/3$$

$$DEV(\#3)=PM\min(\#3)-\{PM\min(\#1)+PM\min(\#2)+PM\min(\#4)\}/3$$

$$DEV(\#4)=PM\min(\#4)-\{PM\min(\#1)+PM\min(\#2)+PM\min(\#3)\}/3$$

Thereafter, the processing proceeds to step 710. It is checked whether or not the absolute value of the cylinder-by-cylinder variation value DEV(#i) of each of the cylinders is larger than a specified value X. As a result, in the case where it is determined that even one of all the cylinder-by-cylinder variation values DEV(#1) to DEV(#4) is larger than the specified value X, the processing proceeds to step 711, and the air-fuel ratio F/B control is inhibited for the cylinder determined to be $|DEV(\#i)|>X$, that is, only for the cylinder in which the cylinder-by-cylinder variation is large. In this case, the normal air-fuel ratio F/B control is performed for the cylinder other than the cylinder in which the cylinder-by-cylinder variation is large (that is, for the cylinder in which the cylinder-by-cylinder variation is small).

On the other hand, in the case where it is determined that all the cylinder-by-cylinder variation values DEV(#1) to DEV(#4) are the specified value X or less ($|DEV(\#i)|\leqq X$), the processing proceeds to step 712, and the air-fuel ratio F/B control is allowed for all the cylinders.

Thereafter, the processing proceeds to step 713, the intake pipe pressure minimum value PMmin(#i) of each of the cylinders is reset, for example, at every cycle (720° C.), and this program is ended.

In the fifth embodiment as described above, since the air-fuel ratio F/B control is inhibited for only the cylinder in which the cylinder-by-cylinder variation is large, while the deterioration of the stabilization of the air-fuel ratio F/B control by the cylinder-by-cylinder variation is prevented, the normal air-fuel ratio F/B control is performed for the cylinder in which the cylinder-by-cylinder variation is small, and the air-fuel ratio controllability can be secured.

In the fifth embodiment, although the air-fuel ratio F/B control is inhibited for only the cylinder in which the cylinder-by-cylinder variation is large, the control gain $\omega$ may be made smaller than a normal value for only the cylinder in which the cylinder-by-cylinder variation is large.

Besides, in the above first to fifth embodiments, although the invention is applied to the air-fuel ratio F/B control, the invention is not limited to the disclosed embodiments. The invention can be applied to various F/B controls influenced by the cylinder-by-cylinder variation, for example, an idle rotation speed F/B control for controlling the opening of an intake air amount control valve (idle speed control valve or throttle valve) so that the engine rotation speed detected by the crankshaft angle sensor 26 is controlled to become the target idle rotation speed.

Besides, in the first to firth embodiments, although the cylinder-by-cylinder variation is calculated on the basis of the maximum value or the minimum value of the intake pipe pressure at every specified period, the calculation method of the cylinder-by-cylinder variation value may be suitably changed. The cylinder-by-cylinder variation value may be calculated on the basis of, for example, an average value of the intake pipe pressure at every specified period, an amplitude value, an area, a locus length, or the like. Besides, the cylinder-by-cylinder variation value may be calculated on the basis of an intake air amount, cylinder inside pressure, rotation speed, ion current, air-fuel ratio or the like instead of the intake pipe pressure.

Besides, in the first to fifth embodiments, although the cylinder-by-cylinder variation is corrected by correcting the fuel injection amount for each of the cylinders, the correction method may be suitably changed. For example, the cylinder-by-cylinder variation may be corrected by correcting the ignition timing for each of the cylinders, or correcting the intake air amount for each of the cylinders.

In addition, the application range of the invention is not limited to the four-cylinder engine, and the invention may be applied to a multi-cylinder engine of five or more cylinders or three or less cylinders.

What is claimed is:

1. An internal combustion engine control apparatus comprising:

a sensor for detecting information relating to an operation state of an internal combustion engine including multiple cylinders; and feedback control means for performing a specified feedback control on the basis of output of the sensor, wherein the feedback control means includes cylinder-by-cylinder variation detection means for obtaining a cylinder-by-cylinder variation value indicating variation in operation states among the cylinders of the internal combustion engine, and control stabilization means for lowering a control gain of the feedback control or inhibiting the feedback control when the cylinder-by-cylinder variation value exceeds a specified range.

2. An internal combustion engine control apparatus according to claim 1, wherein the feedback control means further includes cylinder-by-cylinder variation correction means for correcting the variation in the operation states among the cylinders of the internal combustion engine on the basis of the cylinder-by-cylinder variation value, and wherein the control stabilization means lowers the control gain of the feedback control or inhibits the feedback control when the cylinder-by-cylinder variation correction by the cylinder-by-cylinder variation correction means is not completed.

3. An internal combustion engine control apparatus comprising:

a sensor for detecting information relating to an operation state of an internal combustion engine including multiple cylinders; and feedback control means for performing a specified feedback control on the basis of output of the sensor, wherein the feedback control means includes cylinder-by-cylinder variation detection means for obtaining a cylinder-by-cylinder variation value indicating variation in operation states among the cylinders of the internal combustion engine, cylinder-by-cylinder variation correction means for correcting the variation in the operation states among the cylinders of the internal combustion engine on the basis of the cylinder-by-cylinder variation value, and control stabilization means for lowering a control gain of the feedback control or inhibiting the feedback control when the cylinder-by-cylinder variation correction by the cylinder-by-cylinder variation correction means is not completed.

4. An internal combustion engine control apparatus according to claim 3, wherein the control stabilization means lowers the control gain of the feedback control or inhibits the feedback control until a specified period passes even after the cylinder-by-cylinder variation correction by the cylinder-by-cylinder variation correction means is completed.

5. An internal combustion engine control apparatus according to claim 3, wherein the control stabilization means lowers the control gain of the feedback control or inhibits the feedback control until the cylinder-by-cylinder variation value is decreased into a specified range.

6. An internal combustion engine control apparatus according to claim 3, wherein the control stabilization means performs an air-fuel ratio feedback control to control a fuel injection amount of a fuel injection valve of each of the cylinders so that an air-fuel ratio of exhaust gas detected by an exhaust gas sensor is controlled to become a target air-fuel ratio, and wherein the control stabilization means lowers the control gain of the feedback control or inhibits the feedback control for only the cylinder in which the cylinder-by-cylinder variation exceeds a specified range.

7. An internal combustion engine control apparatus according to claim 3, wherein the cylinder-by-cylinder variation detection means obtains the cylinder-by-cylinder variation value from a difference between one of a maximum or a minimum of an intake pressure of each cylinder of the engine and an average of the maximum or the minimum of the intake pressure of all the cylinders.

8. An internal combustion engine control apparatus according to claim 7, wherein the control stabilization means lowers the control gain of the feedback control when the difference exceeds a specified range.

9. An internal combustion engine control apparatus according to claim 8, wherein the control stabilization means lowers the control gain of the feedback control only for cylinders with respect to which the difference exceeds the specified range.

10. An internal combustion engine control apparatus according to claim 7, wherein the sensor detects an air-fuel ratio in an exhaust of the engine, and the feedback control means feedback controls fuel injection amount of the engine with the control gain.

* * * * *